US012595800B1

(12) United States Patent
You et al.

(10) Patent No.: US 12,595,800 B1
(45) Date of Patent: Apr. 7, 2026

(54) LOW NOISE BLOWER

(71) Applicants: Hyundai Motor Company, Seoul (KR); Kia Corporation, Seoul (KR)

(72) Inventors: Sung Jin You, Hwaseong-Si (KR); Ki Hyun Sim, Hwaseong-Si (KR); Chang Ha Lee, Hwaseong-Si (KR); Jeong Kyu Lim, Hwaseong-Si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 19/220,259

(22) Filed: May 28, 2025

(30) Foreign Application Priority Data

Nov. 29, 2024 (KR) ..... 10-2024-0175656

(51) Int. Cl.

| | |
|---|---|
| ***F04D 23/00*** | (2006.01) |
| ***F04D 5/00*** | (2006.01) |
| ***F04D 29/08*** | (2006.01) |
| ***F04D 29/18*** | (2006.01) |

(52) U.S. Cl.
CPC ..... *F04D 23/008* (2013.01); *F04D 5/002* (2013.01); *F04D 29/08* (2013.01); *F04D 29/188* (2013.01)

(58) Field of Classification Search
CPC ..... F04D 23/008; F04D 5/002; F04D 29/08; F04D 29/188
See application file for complete search history.

(56) References Cited

U.S. PATENT DOCUMENTS

| | | | | |
|---|---|---|---|---|
| 6,425,732 | B1 * | 7/2002 | Rouse | F04D 23/008 415/55.1 |
| 9,303,645 | B2 * | 4/2016 | Oakman | F04D 3/00 |
| 2018/0202451 | A1 * | 7/2018 | Kim | F04D 29/162 |
| 2021/0164488 | A1 * | 6/2021 | Klima | F04D 29/023 |

FOREIGN PATENT DOCUMENTS

| | | | | |
|---|---|---|---|---|
| DE | 102005008388 | A1 * | 8/2006 | F04D 29/284 |

OTHER PUBLICATIONS

Machine Translation of DE-102005008388, 2006 (Year: 2006).*

* cited by examiner

*Primary Examiner* — Michael K. Reitz
(74) *Attorney, Agent, or Firm* — Banner & Witcoff, Ltd.

(57) ABSTRACT

The present disclosure provides a blower that may increase air volume and reduce blade pass frequency (BPF) noise. The blower may include a plurality of casings and an impeller. The impeller may include a rotator, a blade assembly, and a gasket. The rotator may include a hub and an outer rim. The blade assembly may include: a plurality of blades disposed between the hub and the outer rim, and a plurality of flow channels. Each flow channel of the plurality of flow channels may be formed between two adjacent blades of the plurality of blades. The gasket may have a plurality of grooves formed on an outer circumferential surface of the gasket. The plurality of blades may include a plurality of first blades a plurality of second blades. Each of the plurality of second blades may be disposed between two adjacent blades of the plurality of first blades.

6 Claims, 4 Drawing Sheets

LOW NOISE BLOWER

CROSS-REFERENCE TO RELATED APPLICATION

This application claims the benefit of and priority to Korean Patent Application No. 10-2024-0175656, filed in the Korean Intellectual Property Office on Nov. 29, 2024, the entire contents of which are incorporated herein by reference.

TECHNICAL FIELD

The present disclosure relates to a low-noise blower.

BACKGROUND

In general, a blower is a device that is installed in an air conditioner or a refrigeration device to forcibly suction and discharge external air or cold air. Blowers may be classified as a low-pressure blower or a high-pressure blower based on a discharge pressure. Based on the shape of the blade, blowers may also be classified as a regeneration type, a centrifugal type, an axial flow type, or a transverse flow type.

Compared to the centrifugal type and the axial flow type, a regeneration type blower has a simple structure that is excellent in durability and is suitable for obtaining a large head (e.g., fluid head) at a relatively low flow rate.

The regeneration type blower may be used as a fuel pump for a vehicle, an industry-strength high-pressure blower, or a fuel cell blower requiring a high pressure. The regeneration type blower may convert electric energy into mechanical energy to rotate an impeller and transfer a fluid to boost the pressure of the fluid. The rotating impeller absorb energy through collision with the fluid. When the fluid comes in contact with the impeller, a pressure wavelength may be generated, and the pressure wavelength may cause noise.

The regeneration type blower may have a potential vibration frequency, such as a blade pass frequency (BPF). This blade pass frequency may be expressed as a product of the rotational speed of the impeller and the number of blades. The blade pass frequency may generate strong noise (known as BPF noise) in a narrow frequency band. Because the BPF noise is generated when the air periodically discharged by the vortex collides with surrounding components, the position of the center of the vortex or its intensity significantly may affect the magnitude of the BPF noise.

In some implementations of a blower, BPF noise is reduced by lowering the rotational speed of the impeller or correcting the design parameters of the impeller, but this may cause an increase in the size of the impeller or degradation of performance, thereby adversely affecting the system.

SUMMARY

The present disclosure has been made to solve the above-mentioned problems occurring in at least some implementations while advantages achieved by those implementations are maintained intact.

An aspect of the present disclosure provides a low-noise blower that may increase air volume and reducing BPF noise by installing a second blade that generates a pressure wavelength of an opposite phase to that of a pressure wavelength generated in a first blade while maintaining a space or size of the first blade.

The technical problems to be solved by the present disclosure are not limited to the aforementioned problems, and any other technical problems not mentioned herein will be clearly understood from the following description by those skilled in the art to which the present disclosure pertains.

According to one or more example embodiments of the present disclosure, a blower may include: a plurality of casings comprising a first casing and a second casing; and an impeller. The impeller may include: a rotator, a blade assembly, and a gasket. The rotator may include a hub and an outer rim. The blade assembly may include: a plurality of blades disposed between the hub and the outer rim, and a plurality of flow channels. Each flow channel of the plurality of flow channels may be formed between two adjacent blades of the plurality of blades. The gasket may have a plurality of grooves formed on an outer circumferential surface of the gasket. The plurality of blades may include: a plurality of first blades formed to be spaced apart from each other along a plurality of first flow channels, of the plurality of flow channels, that face the second casing; and a plurality of second blades. Each of the plurality of first blades may be a first partition wall that is formed from the hub toward the outer rim. Each of the plurality of second blades may be a second partition wall that is formed on an opposite side, relative to the plurality of first blades, of the rotator. Each of the plurality of second blades may be disposed between two adjacent blades of the plurality of first blades.

The plurality of second blades may be formed on a surface, of the rotator, that faces the gasket.

The plurality of first blades may have a height from the hub to the outer rim. The plurality of second blades may have a height of at least one third of the height of the plurality of first blades.

A first tangential angle, relative to the outer rim, of each of the plurality of first blades may be equal to a second tangential angle, relative to the outer rim, of each of the plurality of second blades.

A quantity of the plurality of first blades may be equal to a quantity of the plurality of second blades.

The plurality of first blades and the plurality of second blades may extend radially and concentrically. An interval between any two of the plurality of first blades may be equal to an interval between any two of the plurality of second blades.

According to one or more example embodiments of the present disclosure, a blower may include: a casing and an impeller. The impeller may include: a hub forming a first circle, and an outer rim forming a second circle larger than the first circle. The first circle, the second circle, and a third circle may be concentric. A rotational axis of the impeller may pass through the centers of the first circle, the second circle, and the third circle. The impeller may further include a blade assembly. The blade assembly may include: a plurality of first blades radially extending from a perimeter of the first circle toward a perimeter of the second circle, and a plurality of second blades radially extending from a perimeter of the third circle toward the perimeter of the second circle. Each of the plurality of second blades may be disposed between two adjacent blades of the plurality of first blades. The outer rim may be disposed between the plurality of first blades and the plurality of second blades along the rotational axis. Each flow channel of a plurality of first flow channels may be formed between two adjacent blades of the plurality of first blades.

The blower may further include: a gasket having a plurality of grooves formed on an outer circumferential surface of the gasket.

The plurality of second blades may be formed on a surface, of a rotator of the impeller, that faces the gasket.

The casing may include a first casing coupled to a second casing. The plurality of first blades may be formed to be spaced apart from each other and face the second casing. Each of the plurality of first blades may be a first partition wall. The plurality of second blades may be formed to be spaced apart from each other and face the first casing. Each of the plurality of second blades may be a second partition wall.

The second partition wall may be shorter than the first partition wall.

A quantity of the plurality of first blades may be equal to a quantity of the plurality of second blades.

The plurality of first blades and the plurality of second blades may extend radially and concentrically. An interval between any two of the plurality of first blades may be equal to an interval between any two of the plurality of second blades.

The second circle may be larger than the third circle. The third circle may be larger than the first circle.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
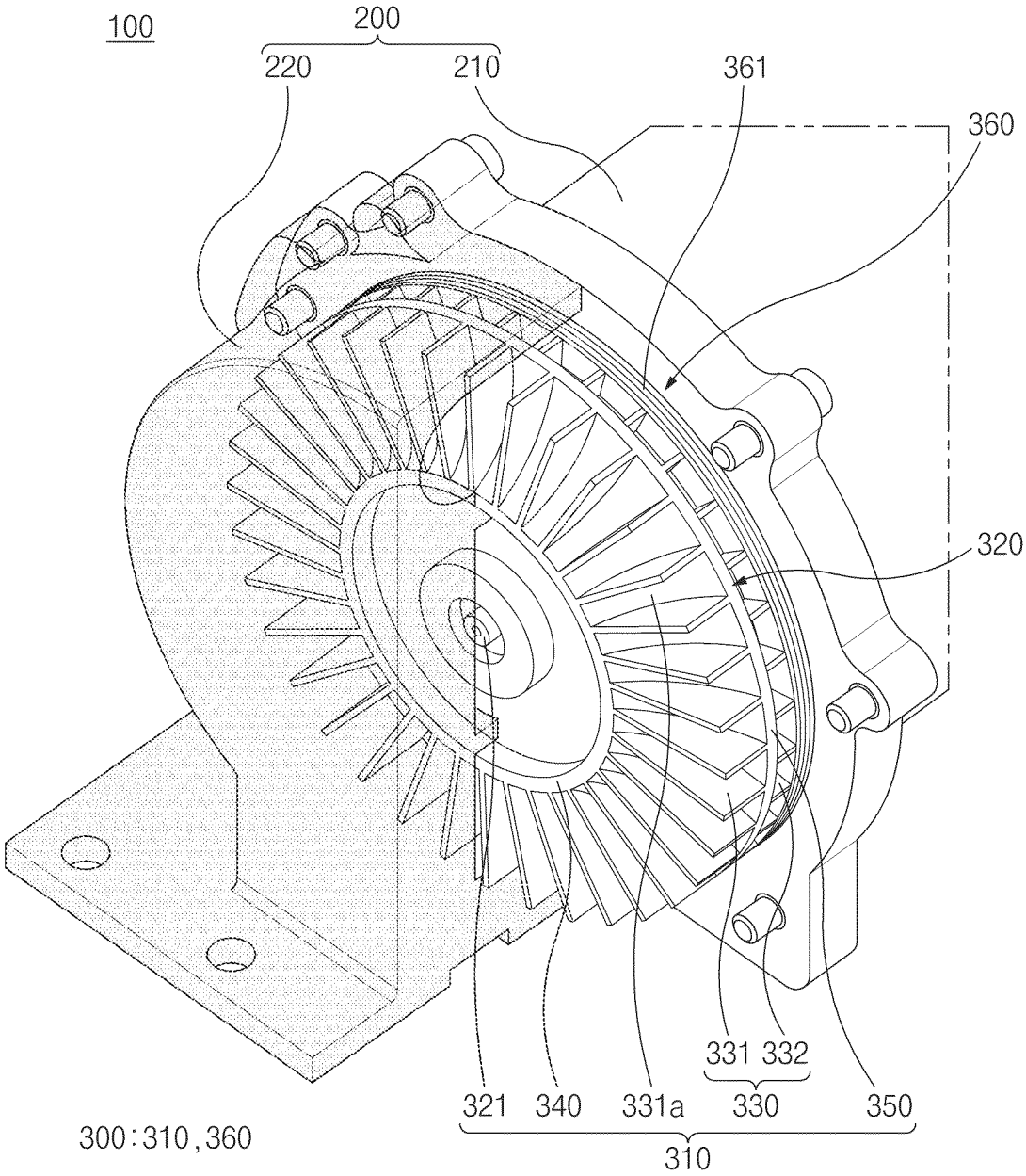
FIG. 1 is a perspective view of an example low-noise blower.

Hereinafter, one or more example embodiments of the present disclosure will be described in detail with reference to the accompanying drawings. In adding reference numerals to the components of the drawings, it should be noted that the same components have the same numerals as possible even when they are illustrated on different drawings. In describing the example embodiments of the present disclosure, detailed descriptions associated with well-known functions or configurations will be omitted if they may make subject matters of the present disclosure unnecessarily obscure.

Furthermore, in describing components of the example embodiments of the present disclosure, the terms first, second, A, B, (a), (b), and the like may be used herein. These terms are only used to distinguish one element from another element, but do not limit the corresponding elements irrespective of the nature, order, or priority of the corresponding elements. When it is described that a certain component is "connected to", "coupled to" or "electrically connected to" a second component, it should be understood that the component may be directly connected or electrically connected to the second component, but a third component may be "connected", "coupled" or "electrically connected" between the components.

For purposes of this application and the claims, using the exemplary phrase "at least one of: A; B; or C" or "at least one of A, B, or C," the phrase means "at least one A, or at least one B, or at least one C, or any combination of at least one A, at least one B, and at least one C. Further, exemplary phrases, such as "A, B, or C", "at least one of A, B, and C", "at least one of A, B, or C", etc. as used herein may mean each listed item or all possible combinations of the listed items. For example, "at least one of A or B" may refer to (1) at least one A; (2) at least one B; or (3) at least one A and at least one B.

Hereinafter, a low-noise blower according to various example embodiments of the present disclosure will be described in detail with reference to the accompanying drawings.

FIG. 1 is a perspective view of an example low-noise blower according to the present disclosure.

Referring to FIG. 1, in a blower 100, a disk-shaped impeller 300 may be installed in the interior of a pair of casings 200. The pair of casings 200 may include a first casing and a second casing (e.g., an inner casing 210 and an outer casing 220). The inner casing 210 and the outer casing 220 may also be referred to as a first casing and a second casing, respectively. The blower 100 may be a pump having a structure, in which external gas is suctioned by the impeller 300 to boost a pressure to a high pressure and then is discharged. However, the present disclosure is not limited thereto, and the blower 100 may also be used as a fuel pump. For example, the blower 100 may be a fuel pump that boosts the pressure of a liquid fuel that is introduced thereinto to a high pressure.

The impeller 300 may include a blade installation part 310 (also referred to as a blade assembly 310) and a blocking part 360. The impeller 300 may be installed inside the blower 100 to be rotatable.

The impeller 300 may include a disk-shaped rotation part 320 (also referred to as a rotator 320). A shaft hole 321 may be formed at the center of the rotator 320. A rotary shaft (not illustrated) of a driving part that will be described later may be connected to the shaft hole 321. The impeller 300 may be rotated by a rotary shaft that receives power by a driving part (not illustrated), such as a motor or the like.

The blade assembly 310 is formed on one side of the impeller 300 to boost the pressure of the gas while being rotated together with the impeller 300.

The blade assembly 310 may include a hub 340, an outer rim 350, and a plurality of blades 330.

The hub 340 may be formed in a ring shape on a side surface of the impeller 300. The hub 340 may be formed to be concentric with the outer rim 350 of the impeller 300. The hub 340 may be formed to be spaced apart (e.g., to be equidistant) from the outer rim 350 of the impeller 300 by a specific distance in an axial direction.

A plurality of blades 330 may be radially formed from the hub 340 toward the outer rim 350. The plurality of blades 330 may include or consist of a plurality of partition walls (also referred to as vanes) that separate the outer rim 350 and the hub 340 of the impeller 300.

A first flow channel **331*a* (e.g., one of a plurality of flow channels 331*a*), which is a circulation space of a gas, may be formed between one blade 330 and another blade 330 that are adjacent to each other. The regeneration type blower 100, in which a plurality of first flow channels 331*a* may be formed, may be of an open channel type. However, it should be noted that the regeneration type blower 100** according to the present disclosure may be applied not only to an open channel type but also to a side channel type.

The plurality of first flow channels 331*a* may face (e.g., be open toward) the outer casing 220. A cross section of each of the plurality of first flow channels 331*a* may have an arc shape. The plurality of first flow channels 331*a* may provide one or more spaces for gas circulation to boost the pressure of the gas by a rotational frictional force when the blades 330 rotate.

The blade assembly 310 may provide a pressure increase to a gas by the rotational frictional force of the rotating blades 330, and the present disclosure is not limited or limited by the structure and shape of the blade assembly 310.

The blocking part 360 may be, for example, a baffle, a gasket, a seal, etc. The blocking part 360 may prevent a gas, the pressure of which is boosted in the blade assembly 310, from leaking. The blocking part 360 may be provided between the blade assembly 310 and the inner casing 210, and may be formed on one side of the outer rim 350 of the impeller 300.

The blocking part 360 may include a plurality of grooves 361 on an outer circumferential surface thereof. The groove 361 may be formed in any one of polygonal shapes, in which grooves and bosses are alternately disposed in a cross section. The blocking part 360 may prevent the gas from leaking between the casing 200 of the blower 100 and the outer rim 350 of the impeller 300.

As an example, when the impeller 300 is rotated at a high speed, the gas, the pressure of which is boosted in the blade assembly 310, may leak between the boundary part between the inner casing 210 and the outer rim 350. In this case, as a plurality of grooves 361 are formed on the outer circumferential surface of the blocking part 360, respectively, a flow resistance occurs due to vortices generated in interiors of the grooves 361. Accordingly, the gas may be prevented from leaking to one side of the blade assembly 310.

Furthermore, the gas introduced into the groove 361 formed in the blocking part 360 of the impeller 300 collides with the structure of the groove 361 to receive a resistance, and when a plurality of grooves 361 is formed, the gas introduced into the grooves 361 may reduce the amount of leakage while continuously colliding with the plurality of grooves 361. Due to the decrease in the amount of gas leakage, the pressure boosted in the blade assembly 310 may be prevented from being lowered by the gas that leaks to a boundary part between the casing 200 of the blower 100 and the outer rim 350.

The blocking part 360 may be provided in a structure of the plurality of grooves 361 formed on the outer circumferential surface, and the present disclosure is not limited or limited by the structure and shape of the grooves 361.

Figure 2:
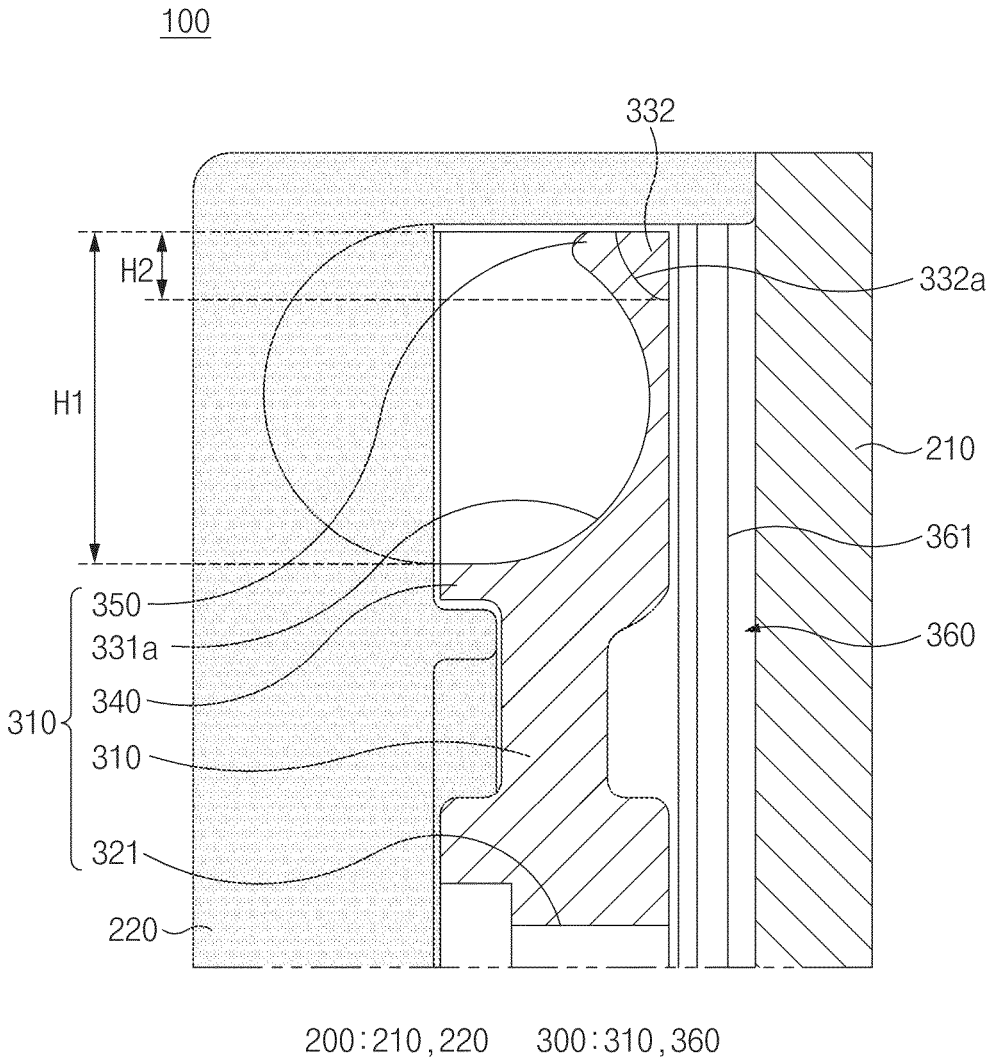
FIG. 2 is a view illustrating heights of first blades and second blades of an example low-noise blower.
Figure 3:
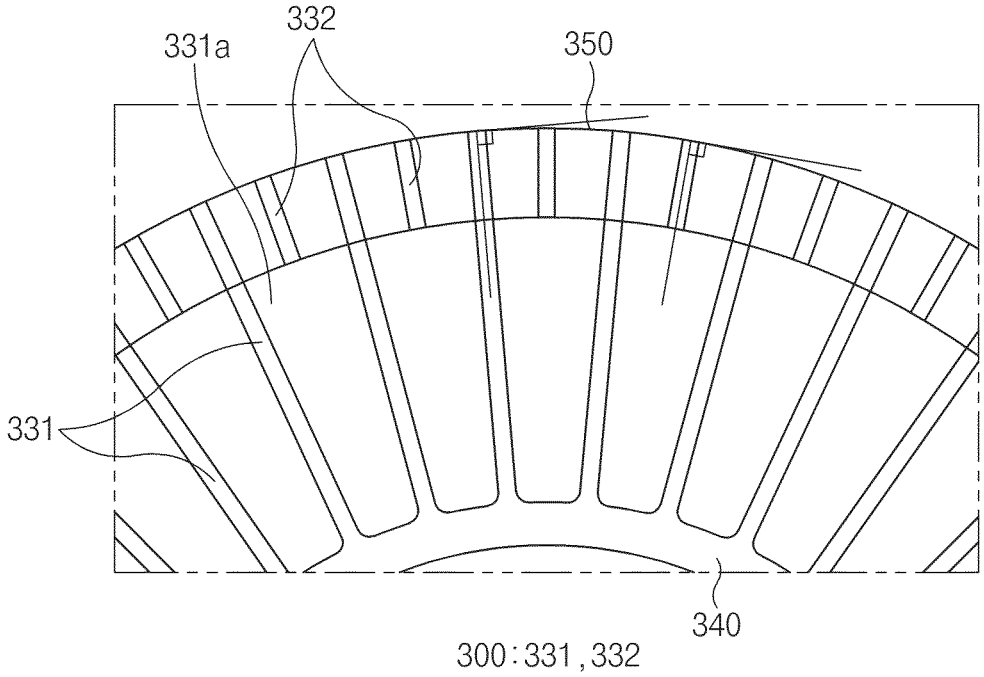
FIG. 3 is a view illustrating disposition of first blades and second blades of an example low-noise blower.

FIG. 2 is a view illustrating the heights of the first blades 331 and the second blades 332 of the low-noise blower 100, and FIG. 3 is a view illustrating the disposition of the first blade 331 and the second blade 332 of the low-noise blower.

The blade may include a first blade 331 (e.g., one of the first blades 331) and a second blade 332 (e.g., one of the second blades 332).

Because the first blade 331 and the second blade 332 are connected on the same axis, they may be rotated at the same rotational speed.

The first blade 331 may be installed in a passage, through which the gas of the outer casing 220 passes, at a position that faces the outer casing 220.

A plurality of first blades 331 are formed to be spaced apart from each other along the plurality of first flow channels 331*a* that face the outer casing 220, and may include a plate-shaped first partition wall that is formed from the hub 340 toward the outer rim 350.

As illustrated in FIG. 2, a height H1 of the first blades 331 may be expressed as a distance from the hub 340 to the outer rim 350.

The second blades 332 may be formed on an opposite side of the rotator 321 relative to the first blades 331.

A portion of a corresponding surface of the rotator 320, which faces the blocking part 360, may be formed without a gap from the blocking part 360, and a space, in which the second blades 332 may be formed, may be secured at an upper end of the corresponding surface of the rotator 320. In the space, in which the second blades 332 may be formed, the cross section of the first flow channel 331*a* (e.g., each of the plurality of first flow channels 331*a*) of a first blade 331 (e.g., each of the plurality of first blades 331) may be formed in an arc shape, and thus, a space for forming the second blades 332 may be formed on the surface of the rotator 320

Accordingly, it is possible to ensure the formation space of the second blades 332 without increasing the size of the impeller 300 at an upper end that is opposite to the first blades 331 with respect to the rotator 320.

A plurality of second blades 332 may be formed to be spaced apart from each other along a plurality of second flow channels 332*a* (e.g., a second flow channel 332*a* may be formed between any two adjacent second blades 332), and may include a second partition wall on the plate that is formed from the outer rim 350 in the direction of the rotation axis. The number (e.g., quantity) of second partition walls of the second blades 332 is the same as the number (e.g., quantity) of first partition walls of the first blades 331.

A height H2 of the second blades 332 may be equal to or greater than one third of the height H1 of the first blades 331. This may be a maximum height for the second blades 332 to generate a sufficient pressure wavelength.

As an example, if the height H2 of the second blades 332 is about one third of the height H1 of the first blades 331 or less, a magnitude of the pressure wavelength generated by the second blades 332 may not be large, and thus, a noise reducing effect of the first blades 331 may be reduced. Accordingly, to reduce the pressure wavelength of the first blades 331, the height H2 of the second blades 332 may need to be sufficiently long.

As illustrated in FIG. 3, in a description of the disposition of the first blades 331 and the second blades 332, each of the second partition walls of the second blades 332 may be disposed between two adjacent first partition walls of the first blades 331. In other words, the first blades 331 and the second blades 332 may be staggered in their positions relative to each other. In this way, the structure, in which the second partition walls of the second blades 332 are disposed between the adjacent first partition walls of the first blades 331, the second blades 332 may generate a pressure wavelength having a phase that is opposite to that of the pressure wavelength generated by the first blades 331.

Accordingly, when the impeller 300 is rotated, the pressure wavelengths generated by the first blades 331 and the second blades 332 are offset by each other, and thus, the size of the total wavelength of the impeller 300 may be reduced.

The pressure wavelength may be relevant to an angle between the first blades 331 and the second blades 332, and may be relevant to a tangential angle, at which the first and second blades 331 and 332 and the outer rim 350 meet each other.

The tangential angles between the first and second blades 331 and 332 and the outer rim 350 may be formed to be the same tangential angle. That is, the plurality of first partition walls of the first blades 331 and the plurality of second partition walls of the second blades 332 may extend radially from the same center (e.g., extend concentrically). Accordingly, the second blades 332 may maintain the pressure wavelength of the opposite phase to that of the first blades 331. Furthermore, the first blades 331 may maintain the pressure wavelength of the opposite phase to that of the second blades 332.

In this way, when the first blades 331 and the second blades 332 maintain pressure wavelengths of opposite phases, the noise generated in the first blades 331 may be offset.

In this way, the first partition walls of the first blades 331 and the second partition walls of the second blades 332 extend radially from the same center (e.g., concentrically), and the interval between the first partition walls of the first blades 331 and the interval of the second part walls of the second blades 332 may be maintained the same.

If the angles of the first blade 331 or the second blade 332 are changed, it is important to maintain the opposite (e.g., complementary) phases by maintaining the angles of the second blades 332 or the first blades 331 at the same angle.

Meanwhile, a portion of the gas generated by the first blades 331 flows through the gas passage of the outer casing 220, but a portion of the gas flows toward the inner casing 210 and leaks, and thus, a flow loss occurs.

However, as the flow rate of the gas of the first blades, in which the gas generated in the second blades 332 leaks, is blocked, the performance of the blower 100 may be improved by preventing the flow loss of the gas of the first blades 331.

Figure 4:
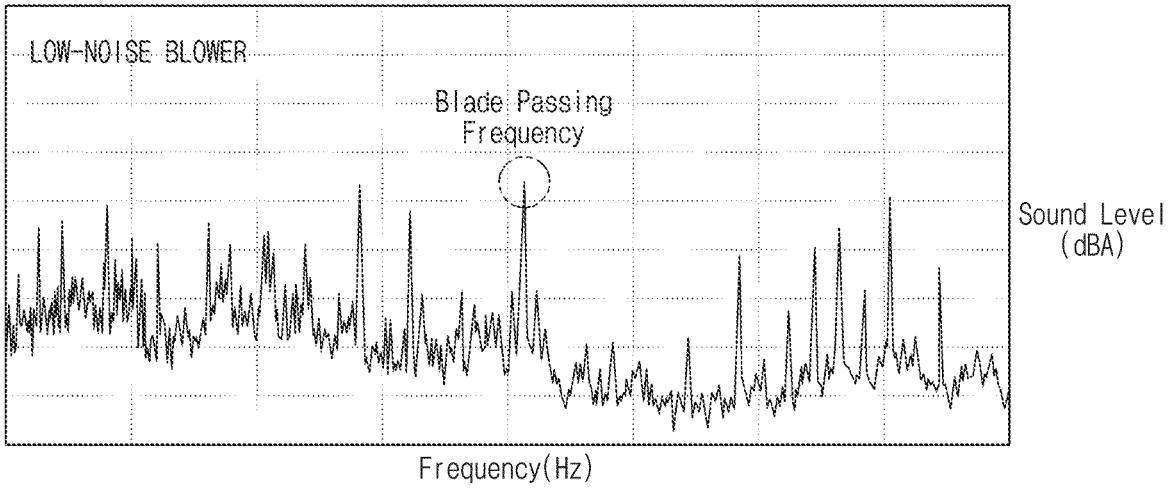
FIG. 4 is a graph for comparing BPF noise measured by the present disclosure and BPF noise measured by a conventional technology.
Figure 4:
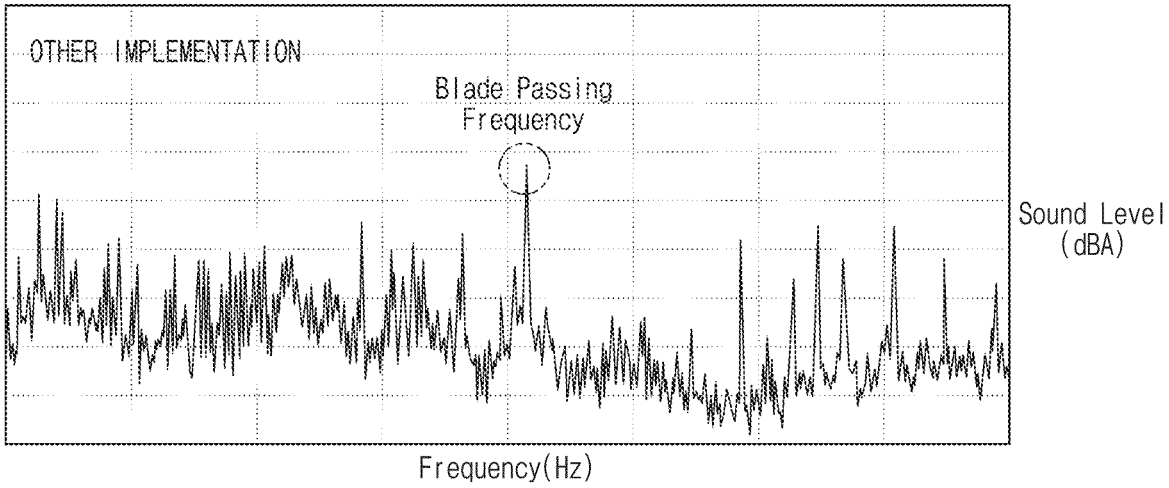

FIG. 4 is a graph for comparing the BPF noise measured by the present disclosure with the BPF noise measured by another implementation, and it may be seen that the BPF noise according to the present disclosure is lower than the BPF noise of the other implementation.

That is, it may be seen that by providing the first blades 331 and the second blades 332 that generate opposite phases, noise generated by the first blades may be offset and reduced.

According to the low-noise blower according to the present disclosure having the above-described configuration, by applying the plurality of second blades, in which the second partition walls are disposed between two adjacent first partitions walls in the first blades to the unutilized space of the first blades while not applying an additional part, it is possible to reduce the BPF noise generated in the blower by generating pressure wavelengths of opposite phases of the first and second blades.

The flow rate of the gas generated in the second blades blocks the leakage generated in the first blades, so that the performance of the blower may be improved.

According to an aspect of the present disclosure, a low noise blower includes a casing including an inner casing and an outer casing, and an impeller including a rotation part, a plurality of blades between a hub and an outer rim of the rotation part, a blade installation part provided with flow channels between the plurality of blades, and a blocking part having a plurality of grooves on an outer circumferential surface thereof, and the blades includes a plurality of first blades formed to be spaced apart from each other along a flow channel facing the outer casing, and including a first partition wall formed from the hub toward the outer rim, and a plurality of second blades including a second partition wall formed on an opposite side of the first blade with respect to the rotation part, and in which the second partition wall is disposed between two adjacent first partition walls in the first blade.

The second blades may be formed at an upper end of a corresponding surface of the rotation part, which faces the blocking part.

The first blades may have a height from the hub to the outer rim, and the second blades may have a height being one third or more of or the same as the height of the first blades.

Tangential angles of the first blades and the second blades, and the outer rim may be formed to be the same tangential angles.

The number of the first partition walls of the first blades may be the same as the number of the second partition walls of the second blades.

The first partition walls of the first blades and the second partition walls of the second blades may extend radially from the same center, and an interval of the first partition walls of the first blades and an interval of the second partition walls of the second blades may be maintained the same.

The above-mentioned description of the present disclosure is intended to be illustrative, and it should be understood by those skilled in the art that the present disclosure may be embodied in other specific forms without departing from the spirit or essential characteristics thereof. Therefore, the above-described embodiments are examples in all aspects, and should be construed not to be restrictive. The scope of the present disclosure is defined by claims to be described below, and it should be interpreted that the scopes or claims of the present disclosure and all modifications or changed forms derived from the equivalent concept are included in the scopes of the present disclosure.

What is claimed is:

1. A blower comprising:

a plurality of casings comprising a first casing and a second casing; and an impeller comprising:

a rotator comprising a hub and an outer rim, a blade assembly comprising:

a plurality of blades disposed between the hub and the outer rim, and a plurality of flow channels, each flow channel of the plurality of flow channels being formed between two adjacent blades of the plurality of blades; and a gasket having a plurality of grooves formed on an outer circumferential surface of the gasket, wherein the plurality of blades comprise:

a plurality of first blades formed to be spaced apart from each other along a plurality of first flow channels, of the plurality of flow channels, that face the second casing, wherein each of the plurality of first blades is a first partition wall that is formed from the hub toward the outer rim; and a plurality of second blades, wherein each of the plurality of second blades is a second partition wall that is formed on an opposite side, relative to the plurality of first blades, of the rotator, and wherein each of the plurality of second blades is disposed between two adjacent blades of the plurality of first blades.

2. The blower of claim 1, wherein the plurality of second blades are formed on a surface, of the rotator, that faces the gasket.

3. The blower of claim 1, wherein the plurality of first blades have a height from the hub to the outer rim, and wherein the plurality of second blades have a height of at least one third of the height of the plurality of first blades.

4. The blower of claim 1, wherein a first tangential angle, relative to the outer rim, of each of the plurality of first blades is equal to a second tangential angle, relative to the outer rim, of each of the plurality of second blades.

5. The blower of claim 1, wherein a quantity of the plurality of first blades is equal to a quantity of the plurality of second blades.

6. The blower of claim 1, wherein the plurality of first blades and the plurality of second blades extend radially and concentrically, and wherein an interval between any two of the plurality of first blades is equal to an interval between any two of the plurality of second blades.

* * * * *